US006524469B1

(12) United States Patent
Schucker

(10) Patent No.: US 6,524,469 B1
(45) Date of Patent: Feb. 25, 2003

(54) HEAVY OIL UPGRADING PROCESS

(75) Inventor: Robert C. Schucker, The Woodlands, TX (US)

(73) Assignee: Trans Ionics Corporation, The Woodlands, TX (US)

( * ) Notice: Subject to any disclaimer, the term of this patent is extended or adjusted under 35 U.S.C. 154(b) by 0 days.

(21) Appl. No.: 09/571,186

(22) Filed: May 16, 2000

(51) Int. Cl.[7] ..... C10G 55/04; C10G 55/02

(52) U.S. Cl. ..... 208/95; 208/96; 208/97; 208/131; 208/132; 208/309

(58) Field of Search ..... 208/95, 96, 97, 208/107, 131, 132, 309

(56) References Cited

U.S. PATENT DOCUMENTS

| | | | | | |
|---|---|---|---|---|---|
| 2,943,050 | A | * | 6/1960 | Beavon | 208/309 |
| 3,132,088 | A | * | 5/1964 | Beuther et al. | 208/16 R |
| 4,200,519 | A | * | 4/1980 | Kwant et al. | 208/106 |
| 4,201,659 | A | * | 5/1980 | Kwant et al. | 208/49 |
| 4,411,790 | A | | 10/1983 | Arod et al. | |
| 4,750,990 | A | * | 6/1988 | Kulkarni et al. | 208/177 |
| 4,797,200 | A | * | 1/1989 | Osterhuber | 208/308 |
| 4,816,140 | A | * | 3/1989 | Trambouze et al. | 208/309 |
| 4,859,284 | A | * | 8/1989 | Rammler et al. | 201/12 |
| 5,173,172 | A | * | 12/1992 | Adams et al. | 106/273.1 |
| 5,182,024 | A | * | 1/1993 | Chen | 210/500.37 |
| 5,785,860 | A | * | 7/1998 | Smith | 208/308 |

FOREIGN PATENT DOCUMENTS

| | | | |
|---|---|---|---|
| CA | 1178231 A | * | 11/1984 |
| EP | 0090441 A1 | * | 10/1983 |
| EP | 0372652 A1 | * | 6/1990 |

OTHER PUBLICATIONS

Viadero, Roger C., et al., "Study of Series Resistances in High–Shear Rotary Ultrafiltration", Journal of Membrane Science, 1999, pp. 199–211, 162, Elsevier Science B.V.

Chang, Thi, "Upgrading and Refining Essential Parts of Orinoco Development", Oil and Gas Journal, Oct. 19, 1998, pp. 67–72.

Le Page, J.F., et al., "Resid and Heavy Oil Processing", Editions Technip: Paris France, 1992, pp. 73–121 and pp. 159–179.

Schucker, R.C., et al., "The Reactivity of Cold Lake Asphaltenes", Amer. Chem. Soc., 1980, pp. 155–159.

* cited by examiner

*Primary Examiner*—Walter D. Griffin
(74) *Attorney, Agent, or Firm*—Jeffrey L. Wendt; Winstead Sechrest & Minick P.C.

(57) ABSTRACT

An improved heavy oil conversion process is disclosed in which the heavy oil feed is first thermally cracked using visbreaking or hydrovisbreaking technology to produce a product that is lower in molecular weight and boiling point than the feed. The product is then deasphalted using an alkane solvent at a solvent to feed ratio of less than 2 wherein separation of solvent and deasphalted oil from the asphaltenes is achieved through the use of a two-stage membrane separation system in which the second stage is a centrifugal membrane.

25 Claims, 1 Drawing Sheet

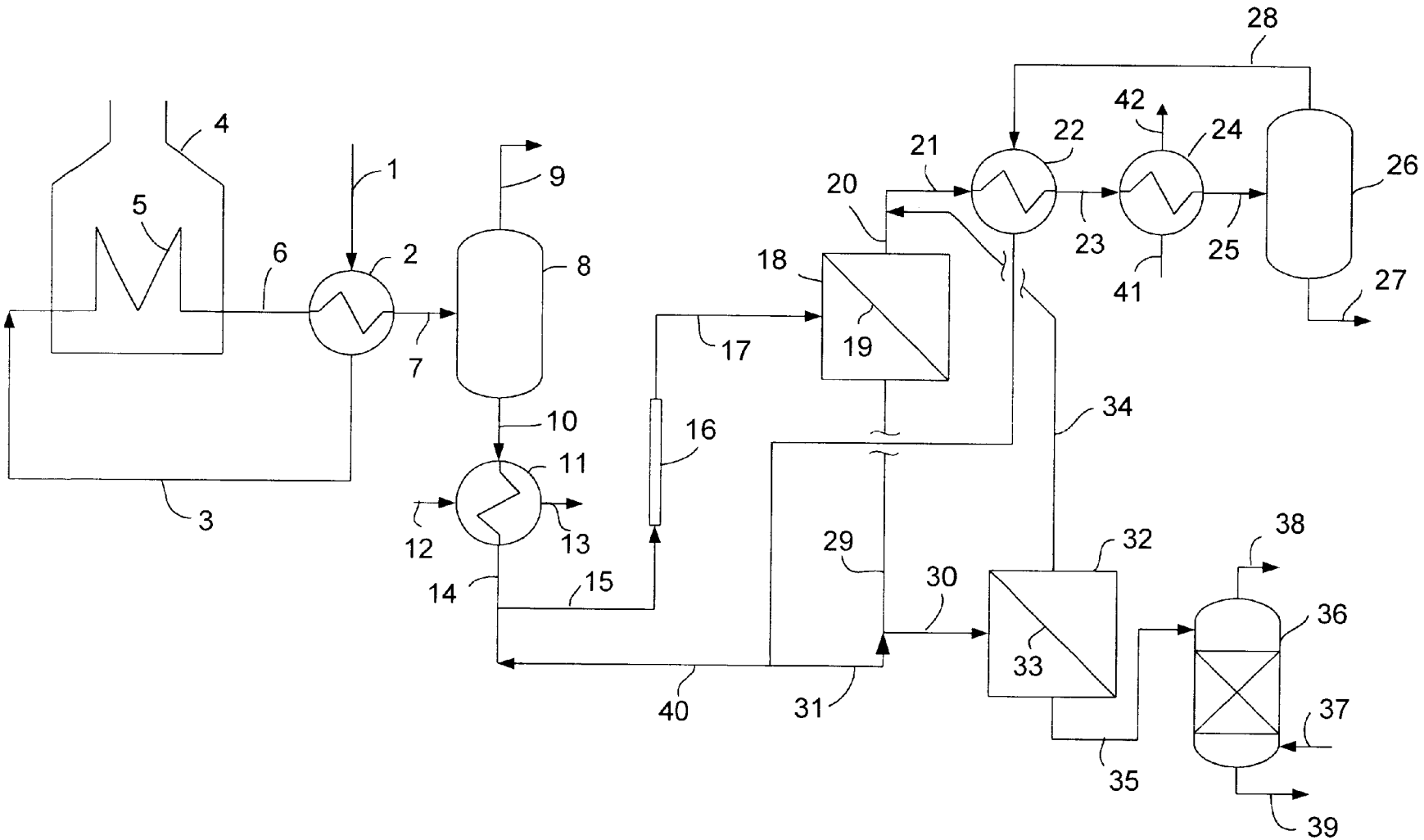
1
2
3
4
5
6
7
8
9
10
11
12
13
14
15
16
17
18
19
20
21
22
23
24
25
26
27
28
29
30
31
32
33
34
35
36
37
38
39
40
41
42

HEAVY OIL UPGRADING PROCESS

FIELD OF THE INVENTION

The present invention relates to a method for the upgrading of heavy hydrocarbon oils and, more specifically, to a method for reducing the viscosity and metals of such oils. The heavy oil is first thermally cracked, then solvent deasphalted.

BACKGROUND

The United Nations Information Centre for Heavy Crude and Tar Sands defines bitumen as petroleum having a viscosity>10,000 cP. Petroleum with viscosity less than 10,000 cP and a density between 10° API and 20° API is defined as heavy oil, while extra heavy oil has a density<10 API. The total estimated resource in place of heavy oil and bitumen in the world is 6.2 trillion barrels. Canada is believed to have 75% of the world's supply of natural bitumen. The Alberta Energy and Utilities Board (AEUB) estimates that there are 1.7 trillion barrels of bitumen in place in Canada, with about 300–350 billion barrels ultimately recoverable. Venezuela, on the other hand, is estimated to contain 65% of the world's reserves of heavy oil. The Orinoco Heavy Oil Belt is estimated to contain 1.2 trillion barrels of extra heavy oil with about 270 billion barrels of it ultimately recoverable.

The distinguishing features of heavy oils are (1) low API gravity, (2) high levels of atmospheric residuum, (3) high viscosity, (4) high levels of sulfur, (5) moderate levels of Conradson Carbon Residue (CCR), and (6) moderate to high levels of metals (Ni and V). These properties, and especially the high viscosity, make recovery of heavy oils difficult. In Canada, subsurface heavy oils from the Cold Lake region are produced by the injection of steam into the ground to lower the viscosity sufficiently to allow the oil to flow. Traditionally, a diluent is then added to the produced oil to further reduce the viscosity of the oil sufficiently to allow it to be pipelined to market. In Venezuela the oil is already warm enough to flow but still too heavy to pipeline directly, thereby also requiring the addition of diluent in order to pipeline it to the upgrading facilities. In both of these cases, the diluent is typically a naphtha stream (21 to 76.6° C. boiling range) which can be separated from the heavy oil by distillation at the end of the pipeline, but which still must be returned to the well to be reused. This involves an additional pipeline and more expense.

The direct upgrading of heavy crudes is also difficult. Distillation typically yields low levels of distillates. The remaining residual oils cannot be added in significant amounts to fluid catalytic crackers because of the extraordinarily high levels of metals and Conradson Carbon Residue (CCR), which result in a high level of hydrogen generation and high coke on catalyst respectively. Therefore, coking, which is one of several thermal cracking processes, has traditionally been the process of choice for upgrading heavy oils. As of 1996, Syncrude Canada processed 214,000 BBL/d of Athabasca tar sands bitumen in their fluid coker (B. L. Schulman et al.; Upgrading Heavy Crude Oils and Residues to Transportation Fuels: Technology, Economics and Outlook, 1996, SFA Pacific, Inc., Mountain View, Calif.). In addition, four separate consortia have planned major upgrading projects in Venezuela; and delayed coking has been the unanimous choice for the primary upgrader in each of them (T. Chang; *Upgrading and Refining Essential Parts of Orinoco Development*, Oil and Gas J., Oct. 19, 1998, 67–72). While coking does remove a significant amount of the metals and carbon residue, the quality of the coker liquids is poor. They are high in sulfur, olefins, diolefins and heavy aromatics and, as a result, require a substantial amount of additional hydrotreating before they can be sent to fluid catalytic cracking units or blended into transportation fuels.

One alternative to coking is visbreaking, which is another widely applied thermal cracking process for the conversion of residual oils (J. F. LePage et al.; Resid and Heavy Oil Processing, Editions Technip, Paris, France, 1992). As of 1996 there was almost 4 million barrels per day visbreaking capacity installed worldwide with more than 95% of that capacity outside the United States. Visbreaking is characterized by high temperature and short residence time; so that, unlike coking, the cracking reactions are terminated before coke is made. Nevertheless, 50 to 60% conversion of 343° C.+fraction of the feed to a lower boiling range can easily be obtained in visbreaking under certain conditions. Visbreaking alone does not significantly change the heteroatom content (S, N), metals or asphaltene content of the feed. Its sole function is molecular weight (e.g. boiling range) reduction and, hence, lowering of viscosity.

Another process commonly used in the upgrading of heavy oils is solvent deasphalting. In the crude, asphaltenes are held in a colloidal solution (or "peptized") by the polar molecules and the aromatic molecules. If an aliphatic solvent is added (as during solvent deasphalting), the nature of the liquid around the asphaltenes changes from one that favors peptization (and therefore stability) of the asphaltene colloids to one that does not favor peptization and therefore precipitates asphaltenes. Visbreaking and other mild thermal processes result in cleavage of the alkyl side chains from asphaltenes (R. C. Schucker and C. F. Keweshan, *The Reactivity of Cold Lake Asphaltenes*, Prepr. Div. Fuel Chem., Amer. Chem. Soc., 1980, 25(3), 155–165). This has two effects: (1) the aromatic cores are less able to be peptized because the side chains are gone and (2) the surrounding liquid becomes more aliphatic (more like an aliphatic deasphalting solvent) and therefore is not as good at solubilizing the asphaltenes. As a result, during visbreaking, asphaltenes will begin to precipitate and subsequently will form deposits, which, if not controlled, plug the tubes with coke. Ordinary solvent deasphalting, as practiced commercially, uses a solvent to feed ratio of 4:1 to 6:1, thus resulting in increased energy consumption for solvent removal and larger equipment sizes. Therefore, there remains a need in the art for improvements to heavy feed upgrading that will overcome the above shortcomings.

SUMMARY OF THE INVENTION

In accordance with the present invention there is provided a process for the upgrading of a heavy oil feedstock that comprises the steps of thermally cracking said feedstock at conditions that will produce a thermally cracked product stream having a lower average molecular weight and boiling point than said feedstock without significant coke formation; volatilizing from said product stream light ends including any water that might be in the stream; adding an alkane solvent to said devolatilized product stream thereby inducing the formation of asphaltene aggregates; passing said devolatilized product/solvent mixture to a first membrane permeation unit; recovering a permeate/solvent stream that is substantially reduced in asphaltenes; heating said permeate/solvent stream above the critical point of said solvent; recovering said solvent and recycling it to the discharge of said thermal cracker; recovering a substantially deasphalted oil product; mixing the retentate stream from said first membrane permeation unit, which is substantially increased in asphaltenes, with the same deasphalting solvent; passing said retentate stream/solvent mixture to a second membrane permeation unit, wherein a substantial portion of the remaining liquid in said retentate/solvent stream that is substantially reduced in asphaltenes permeates through the membrane; and recovering a high-solids retentate stream comprising predominantly asphaltenes, steam stripping said retentate and recovering the solids.

In a preferred embodiment of the invention the feed is a heavy oil stream having an API gravity of less than 10° API.

In another preferred embodiment of the invention the visbreaker is a coil visbreaker design.

In another preferred embodiment of the invention the visbreaker is operated under hydrogen at a pressure of about 100 psig to about 1200 psig.

In another preferred embodiment of the invention the visbroken product is solvent deasphalted using an alkane solvent having from about 2 to about 8 carbons.

In still another preferred embodiment of the invention the solvent deasphalting is carried out at a solvent to feed ratio equal to or less than 2.

In still another preferred embodiment of the invention the asphaltenes are separated from the solvent/deasphalted oil mixture by membrane separation.

In yet another preferred embodiment of the invention the membrane unit may have a tubular configuration, a centrifugal configuration or preferably a combination of the two.

BRIEF DESCRIPTION OF THE DRAWINGS

The FIGURE is a process flow sheet of one preferred embodiment of the present invention.

FIG. 1 is a process flow sheet of one preferred embodiment of the present invention.

DETAILED DESCRIPTION OF THE INVENTION

The present invention relates to a process for upgrading heavy oils, preferably petroleum heavy oils, using a combination of thermal cracking, with and without added hydrogen, at conditions that will not produce significant amounts of coke, followed by membrane deasphalting. Suitable heavy oil feedstocks for use in the present invention include heavy and reduced petroleum crude oil; petroleum atmospheric distillation bottoms; petroleum vacuum distillation bottoms, or residuum; pitch; asphalt and tar sand bitumen. Such feeds will typically have a Conradson carbon content of at least 5 wt. %, generally from about 5 to 50 wt. %. As to Conradson carbon residue, see ASTM Test D189-165. Preferably, the feed is a petroleum vacuum residuum.

A typical heavy petroleum oil suitable for use in the present invention will have the composition and properties within the ranges set forth below.

| | |
|---|---|
| Conradson Carbon | 5 to 40 wt. % |
| Sulfur | 1.5 to 8 wt. % |
| Hydrogen | 9 to 11 wt. % |
| Nitrogen | 0.2 to 2 wt. % |
| Carbon | 80 to 86 wt. % |
| Metals | 1 to 2000 wppm |

-continued

| | |
|---|---|
| Boiling Point | 340° C.+ to 566° C+ |
| Gravity | −10 to 20° API |

Thermal cracking, as employed herein, is typically referred to as visbreaking and usually results in about 30 to 60 wt. % conversion of the heavy oil feed to lower boiling products. At conversions level in excess of about 60 wt. % (even in the presence of hydrogen), coke formation starts to become a problem. There are two leading configurations for visbreakers—coil crackers and soaker crackers; however, the simplicity of the coil cracker makes it the preferred choice for the present invention. The entire reaction takes place in a coil located in a furnace; and the average residence time of the feed in the reaction zone (>450° C.) is only about a minute. The severity in visbreakers is measured in "equivalent seconds" at some reference temperature—for instance 90 seconds at 469° C.

Visbreaking typically is carried out at lower pressures; however, some improvement in the quality and stability of the product can be achieved by the addition of hydrogen at 100 to 1200 psig. Thus, hydrovisbreaking will generally result in a higher quality product but also a higher capital cost (higher pressure reactor tubing and the need to supply hydrogen which may not be readily available).

More particularly, the present invention is directed to an improved process for solvent deasphalting of thermally cracked (visbroken or hydrovisbroken) heavy feeds at very low solvent to feed ratios using ultrafiltration.

Referring now to the figure, a heavy oil feed is introduced to the process through line 1 and is passed through heat exchanger 2 where it is preheated using product from thermal cracking unit 4. Preheated feed in line 3 is then sent to thermal cracking unit 4 containing heating coils 5. Thermal cracking severity will typically range from 60 to 90 equivalent seconds at 469° C., without the formation of substantial amounts coke. The thermally cracked feed exits the thermal cracking unit 4 through line 6 and enters the feed preheater 2, whereupon it is cooled to an intermediate temperature (typically about 204 to 232° C.) which is suitable for introduction into flash tower 8, where light ends and any residual water are volatilized and exit through line 9. Water can be deleterious to some processes used subsequently for further upgrading the heavy oil. The less volatile fraction of the thermally cracked product stream exits the flash tower through line 10 and is further cooled to a temperature of about 75° C. to about 125° C., preferably to about 100IC, by passing through heat exchanger 11. Heat exchanger 11 uses cooling water, which enters through line 12 and exits through line 13.

The cooled thermally cracked product contained in line 14 is mixed with a predominantly alkane deasphalting solvent that is recycled from another part of the process through line 40. Non-limiting examples of preferred alkane solvents include the $C_2$ to $C_8$ normal alkanes, preferably n-pentane ($C_5$). The ratio of solvent to feed is 2:1 or lower. The mixture of oil and solvent passes through line 15 to a static mixer 16 where efficient mixing is accomplished resulting in the precipitation of asphaltenes particles. Because of the viscosity of the mixture at these low solvent to oil ratios, asphaltenes precipitated in this way are incapable of settling out in a tower as is done commercially at higher solvent to feed ratios. That is, solvent to feed ratios of from about 4:1 to about 6:1 are required for efficient asphaltene settling. The asphaltene instability produced by visbreaking is used advantageously in the present invention to achieve deasphalting at solvent to oil ratios less than 2:1, preferably less than 1:1, which results in both energy savings and lower capital costs. These low solvent to oil ratios are not taught in the art. This solid/liquid mixture then passes through line 17 into a first membrane permeation unit 18, which contains a membrane 19 having an average pore size of from 40 to 1000 Å. In considering what pore size to use, one will weigh that a smaller pore size will increase asphaltene separation but reduce permeate flux. The literature commonly recommends an average pore size of about 250 Å or less, if a product of pipeline quality is to be produced. By "pipeline quality" is meant that the oil viscosity will be less than about 500 mPa.s at 40° C. The membrane may be composed of any suitable material, such as a polymeric composition or a ceramic material. Preferred materials include but are not limited to alumina ($Al_2O_3$), titania ($TiO_2$), zirconia ($ZrO_2$) or silica ($SiO_2$). Ceramic materials are preferred because they can withstand the higher temperatures that may be needed to process the heavy oil feed. Such membranes are discussed in U.S. Pat. Nos. 4,441,790 and 5,785,860 both of which are incorporated herein by reference. Centrifugal membrane systems take advantage of the high shear between a rotating membrane surface and the fluid that is being filtered to significantly reduce the thickness of the gel layer and thus increase the rate of permeation. Preferred rotational speeds range from 100 to 2000 rpm (Viadero, R. C.; R. L. Vaughan and B. R. Reed, *Study of Series Resistances in High-Shear Rotary Ultrafiltration*, J. Mem. Sci., 162, 1999, 199–211).

Membrane permeation unit 18 may be in the form of a tubular membrane system, where the feed is pumped at a high rate past the stationary membrane, or a centrifugal membrane system where the membrane rotates at about 1000 rpm. Permeation through the membrane in either case is achieved by way of a pressure gradient across the membrane.

Permeate having passed through membrane 19 exits the membrane permeation unit through line 20 where it is mixed with permeate from a second membrane permeation unit 32 entering through line 34. The mixed permeate streams pass through line 21 into heat exchanger 22 where they are preheated to a temperature from about 140° C. to about 180° C. (preferably 160° C. if n-pentane is used as the deasphalting solvent) by vapor which passes through line 28 from the solvent separator 26. For other deasphalting solvents, the temperature is increased to within about 10 to 50° C. below the solvent critical temperature. Pressure in this stream is maintained above 500 psig. The preheated mixed permeate stream then passes through line 23 to a second heat exchanger where the temperature is raised to a temperature approximately 50° F. (25° C.) above the critical temperature of the solvent [225° C., if using n-pentane] by steam entering through line 41 and exiting through line 42. The superheated stream then passes through line 25 to the solvent separator 26, which disengages the deasphalted oil from the supercritical solvent. Supercritical solvent passes through line 28 to heat exchanger 22 where it is cooled to within 10° C. of the normal boiling point of the solvent, condensed to a liquid and passes through line 40 to be mixed with freshly visbroken feed.

Retentate, or that portion of the feed not permeated through membrane 19, exits the first membrane permeation unit through line 29 and is mixed with deasphalting solvent which enters through line 31, said deasphalting solvent being the same as that used in the first filtration stage. The mixed streams then pass through line 30 into a second membrane permeation unit 32 containing an ultrafiltration membrane 33 having an average pore size of from 40 to 250 Å. The purpose of membrane permeation unit 32 is to recover liquids that are associated with the solid asphaltenes in stream 29. Permeate from membrane permeation unit 32 passes through line 34 to be mixed with permeate from membrane permeate unit 18. Retentate from membrane permeation unit 32 exits through line 35 as a high-solids stream and enters stripper vessel 36 where the solids are counter-currently stripped with steam that enters the vessel through line 37. Vaporized solvent and volatile portions of the solid/liquid mixture are removed through line 38 and solid asphaltenes exit through line 39.

Persons of ordinary skill in the art will recognize that many modifications in this process are possible, including but not limited to (a) the use of hydrovisbreaking as the thermal cracking step, (b) different integration of the heat exchangers for optimum heat utilization, (c) the use of two centrifugal membrane permeation units rather than a tubular unit followed by a centrifugal and (d) recovery of solvent from the deasphalted oil/solvent mixture by sub-critical methods. The embodiment described herein is meant to be illustrative only and should not be taken as limiting the invention, which is defined in the following claims.

What is claimed is:

1. A process for the upgrading of a heavy oil feedstock that comprises the steps of thermally cracking said feedstock in a thermal cracking unit at conditions that will produce a thermally cracked product stream having a lower average molecular weight and boiling point than said feedstock without significant coke formation;

volatilizing from said product stream light ends including any water that might be in the stream to form a devolatilized product stream;

adding an alkane solvent to said devolitized product stream thereby inducing the formation of asphaltene aggregates and forming a devolatilized product/solvent mixture;

passing said devolatilized product/solvent mixture to a first membrane permeation unit;

recovering a permeate/solvent stream that is reduced in asphaltenes;

heating said permeate/solvent above the solvent critical point;

recovering said solvent and recycling it to a discharge of said thermal cracking unit;

recovering a substantially deasphalted oil product;

mixing a first retentate stream from said first membrane permeation unit, which is increased in asphaltenes, with a portion of the alkane solvent to form a first retentate/solvent mixture; passing said first retentate stream/solvent mixture to a second membrane permeation unit, to recover liquids that are associated with the asphaltenes in said first retentate/solvent mixture as a second permeate, which permeates through the second membrane; and recovering a high-solids retentate stream comprising predominantly asphaltenes, steam stripping said high-solids retentate and recovering the solids.

2. A process of claim 1 wherein the thermal cracking unit is a visbreaker.

3. A process of claim 1 wherein the thermal cracking unit is a hydro-visbreaker.

4. A process of claim 2 wherein the visbreaker operates at a severity ranging from 25 to 150 equivalent seconds at 469° C.

5. A process of claim 2 wherein the visbreaker pressure is 50 to 150 psig.

6. A process of claim 3 wherein the hydro-visbreaker operates at a severity ranging from 25 to 150 equivalent seconds at 469° C.

7. A process of claim 3 wherein the hydro-visbreaker hydrogen pressure is 10–1200 psig.

8. A process of claim 1 wherein the first membrane permeation unit is a tubular membrane system.

9. A process of claim 8 wherein the membrane in the first membrane permeation unit has an average pore size from 40 to 1000 Å.

10. A process of claim 1 wherein the first membrane permeation unit is a centrifugal membrane system.

11. A process of claim 10 wherein the membrane in the first membrane permeation unit has an average pore size from 40 to 1000 Å.

12. A process of claim 10 wherein the centrifugal membrane rotates at from 100 rpm to 3000 rpm.

13. A process of claim 1 wherein the second membrane permeation unit is a centrifugal membrane system.

14. A process of claim 13 wherein the membrane in the second membrane permeation unit has an average pore size from 40 to 250 Å.

15. A process of claim 13 wherein the centrifugal membrane rotates at from 100 rpm to 3000 rpm.

16. A process of claim 13 wherein the solids content of the high-solids retentate stream from the second membrane permeation unit is greater than 40 weight percent.

17. A process of claim 1 wherein the second permeate is combined with the permeate/solvent stream to from a combined permeate, and deasphalted oil and solvent in the combined permeate are separated under conditions above the critical point of the solvent.

18. A process of claim 1 wherein the second permeate is combined with the permeate/solvent stream to from a combined permeate, and deasphalted oil and solvent in the combined permeate are separated under conditions below the critical point of the solvent.

19. A process of claim 1 wherein the high-solids retentate from the second membrane permeation unit is steam stripped to recover volatile solvent and deasphalted oil.

20. A process of claim 8 in which the devolatilzed product/solvent mixture has a solvent to oil ratio less than 2.0.

21. A process of claim 8 in which the alkane solvent is an alkane containing from 2 to 8 carbons.

22. A process of claim 10 in which the devolatilized product/solvent mixture has a solvent to oil ratio less than 2.0.

23. A process of claim 10 in which the alkane solvent is an alkane containing from 2 to 8 carbons.

24. A process of claim 15 in which the first retentate/solvent mixture has a solvent to oil ratio less than 2.0.

25. A process of claim 15 in which the alkane solvent is an alkane containing from 2 to 8 carbons.

* * * * *